US005931091A

United States Patent [19]

Kobayashi

[11] Patent Number: 5,931,091

[45] Date of Patent: Aug. 3, 1999

[54] MULTICOLOR OFFSET PERFECTING PRESS

[75] Inventor: Mikio Kobayashi, Tokyo-to, Japan

[73] Assignee: Jei Emu Insatsu Kikai Kabushiki Kaisha, Tokyo, Japan

[21] Appl. No.: 09/095,962

[22] Filed: Jun. 11, 1998

[30] Foreign Application Priority Data

Jun. 20, 1997 [JP] Japan ..... 9-179102

[51] Int. Cl.[6] ..... B41F 5/16

[52] U.S. Cl. ..... 101/177; 101/183; 101/229

[58] Field of Search ..... 101/177, 229, 101/183, 211

[56] References Cited

U.S. PATENT DOCUMENTS

| | | | |
|---|---|---|---|
| 4,732,084 | 3/1988 | Wirz | 101/177 |
| 4,854,231 | 8/1989 | Jahn | 101/177 |
| 5,016,529 | 5/1991 | Jahn | 101/211 |
| 5,136,943 | 8/1992 | Fischer et al. | 101/183 |
| 5,586,499 | 12/1996 | Beaumont et al. | 101/211 |

FOREIGN PATENT DOCUMENTS

| | | |
|---|---|---|
| 63-87234 | 4/1988 | Japan . |
| 321346 | 3/1991 | Japan . |
| 6336003 | of 1994 | Japan . |

*Primary Examiner*—Edgar Burr
*Assistant Examiner*—Minh Chall
*Attorney, Agent, or Firm*—Price, Heneveld, Cooper, DeWitt & Litton

[57] ABSTRACT

A multicolor offset perfecting press comprising a printing station having offset cylinders, plate cylinders in contact and operatively associated with the offset cylinders, and compression cylinders and at least one intermediate cylinder both having their diameters threefold larger than those of the offset cylinders. The printing station comprises at least a pair of back side printing units and at least a pair of top side printing units arranged to be successively in contact and operatively associated together. Each of the back side printing units is adapted to be horizontally in contact and operatively associated, on one side, with one of the compression cylinders and in contact and operatively associated, on the other side, with vertically paired offset cylinders. Each of the top side printing units is adapted to be horizontally in contact and operatively associated, on one side, with the intermediate cylinder and horizontally in contact and operatively associated, on the other side, with the intermediate cylinder or one of the compression cylinder of the back side printing unit. The pairs of offset cylinders are horizontally spaced from each other to be in contact and operatively associated from obliquely above with the respective compression cylinders lying on the feeder side and the delivery side. The multicolor offset perfecting press also includes a feeder station that has a feeder cylinder in contact and operatively associated from obliquely above with the compression cylinder lying on the feeder side. A delivery station is further included having a delivery cylinder in contact and operatively associated from obliquely above with the compression cylinder lying on the delivery side.

3 Claims, 2 Drawing Sheets

MULTICOLOR OFFSET PERFECTING PRESS

BACKGROUND OF THE INVENTION

1. Field of the Invention

This invention relates to a multicolor offset perfecting press adapted to multicolor print paper sheets successively transported from a feeder station on both sides thereof.

2. Description of the Related Art

Most of the conventional multicolor offset perfecting presses are adapted to four-color print the top side and to four-color print the back side of the paper sheet. It is known to assemble compression cylinders integrally so that they are successively in contact and operatively associated one with another in a longitudinally zigzag configuration (Japanese Patent Publication No. 1991-21346). A perfecting press of the above-mentioned type is well-known, in which the compression cylinders are horizontally in contact and operatively associated with one another and integrally assembled together with the offset cylinders and the plate cylinders so that the back side of the paper sheet cannot be printed more than two colors (Japanese Patent Application Disclosure Gazette No. 1988-87234). A multicolor offset perfecting press is also well-known which comprises top side printing units each having a single offset cylinder in contact and operatively associated with an upper portion of each compression cylinder included in the top side printing units, and back side printing units each having a single offset cylinder in contact and operatively associated with a lower portion of each compression cylinder included in the back side printing units so that the top side printing units and back side printing units are alternately in contact and operatively associated together (Japanese Patent Application Disclosure Gazette No. 1994-336003).

The press disclosed in Japanese Patent Publication No. 1991-21346 cannot be used in practice since, if it is desired to multicolor print a paper sheet of a relatively large size, the total height of the press will be unacceptably large. The press proposed by Japanese Patent Application Disclosure Gazette No. 1988-87234 also cannot be used in practice, since this press includes a delivery cylinder having a diameter that is too large to keep offset cylinders in contact with a compression cylinder which is in contact and operatively associated with the delivery cylinder. In addition, this press cannot print the back side of the paper sheet more than two colors. Finally, the press disclosed in Japanese Patent Application Disclosure Gazette No. 1994-336003 comprises the top side printing units and the back side printing units alternately in contact and operatively associated with the top side printing units, and a single-color printing is achieved by each printing unit. To achieve four-color printing on the top side and four-color printing on the back side, this press requires eight compression cylinders. This means that the number of times the paper sheet is transferred from one cylinder to the next cylinder and, in consequence, a desired print registering and, therefore, high precision multicolor printing cannot be expected.

SUMMARY OF THE INVENTION

In view of the problem as has been described above, it is a principal object of the invention to provide a novel multicolor offset perfecting press requiring a relatively small space and allowing the number of times the paper sheet must be transferred from one cylinder to the next cylinder to be effectively reduced, thereby allowing high precision multicolor printing that is well registered to be obtained. In this way, the invention aims to provide a novel multicolor offset perfecting press allowing its maintenance to be facilitated.

The object set forth above is achieved, according to the invention, by a multicolor offset perfecting press comprising a printing station having offset cylinders, plate cylinders in contact and operatively associated with the offset cylinders, and compression cylinders and at least one intermediate cylinder both having their diameters threefold larger than those of the offset cylinders. The printing station includes at least a pair of back side printing units and at least a pair of top side printing units arranged to be successively in contact and operatively associated together. Each of the back side printing units is adapted to be horizontally in contact and operatively associated, on one side, with one of the compression cylinders and in contact and operatively associated, on the other side, with vertically paired offset cylinders. Each of the top side printing units is adapted to be horizontally in contact and operatively associated, on one side, with the intermediate cylinder and in contact and operatively associated, on the other side, with the intermediate cylinder or one of the compression cylinders of the back side printing unit. The pairs of offset cylinders are horizontally spaced from each other to be in contact and operatively associated from obliquely above with the respective compression cylinders lying on the feeder side and the delivery side. A feeder station is included and has a feeder cylinder in contact and operatively associated from obliquely above with the compression cylinder lying on the feeder side. The multicolor offset perfecting press further has a delivery station including a delivery cylinder in contact and operatively associated from obliquely above with the compression cylinder lying on the delivery side.

Preferably, the back side printing units are provided on the feeder side and the delivery side, respectively, and the top side printing units are provided between the back side printing units.

These and other features, advantages and objects of the present invention will be further understood and appreciated by those skilled in the art by reference to the following specification, claims and appended drawings.

DETAILED DESCRIPTION OF THE PREFERRED EMBODIMENTS

Figure 1:
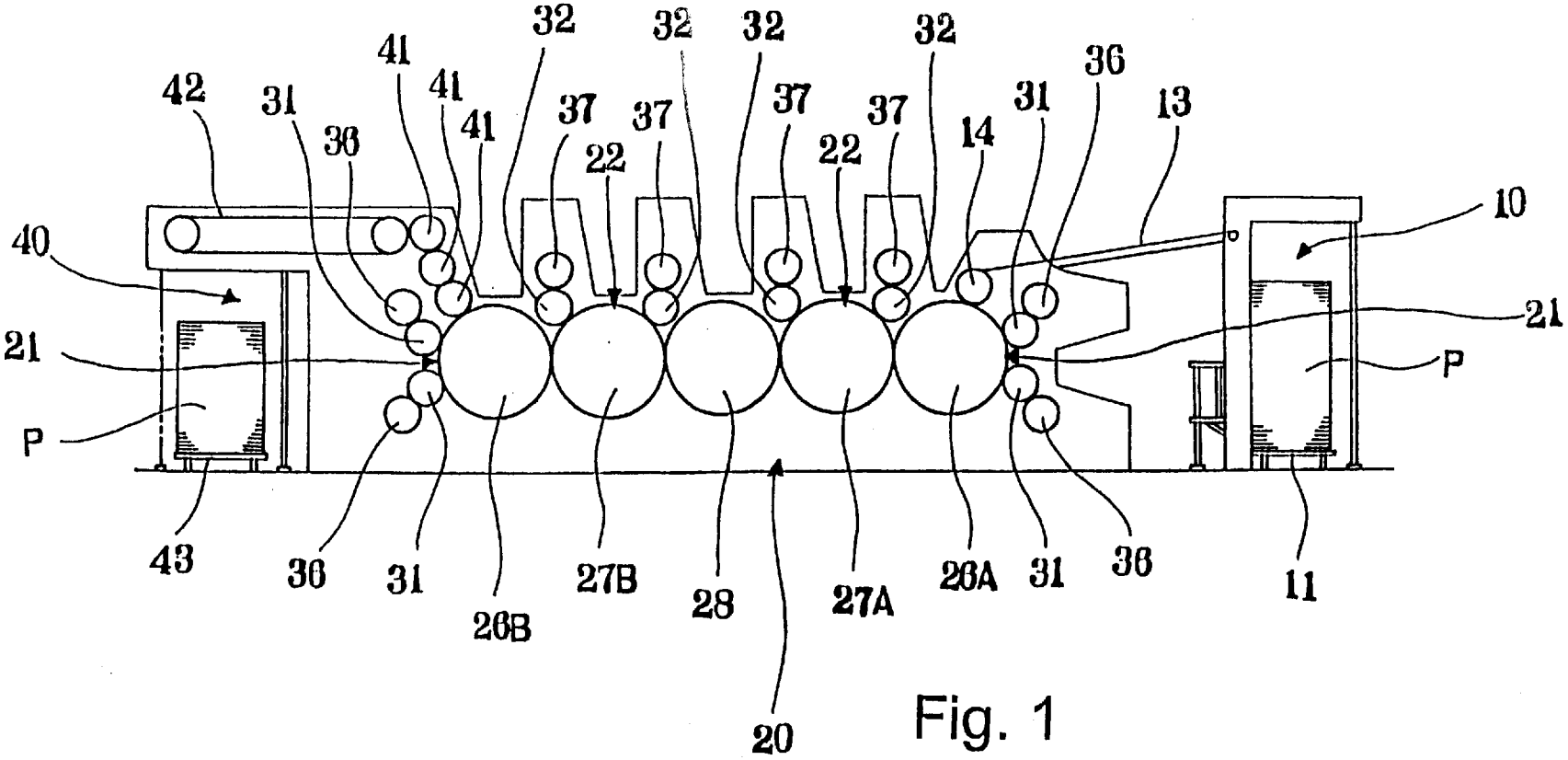
FIG. 1 is a side view schematically illustrating a multicolor offset perfecting press according to the invention particularly adapted for four-color printing on the top side and four-color printing on the back side.
Figure 2:
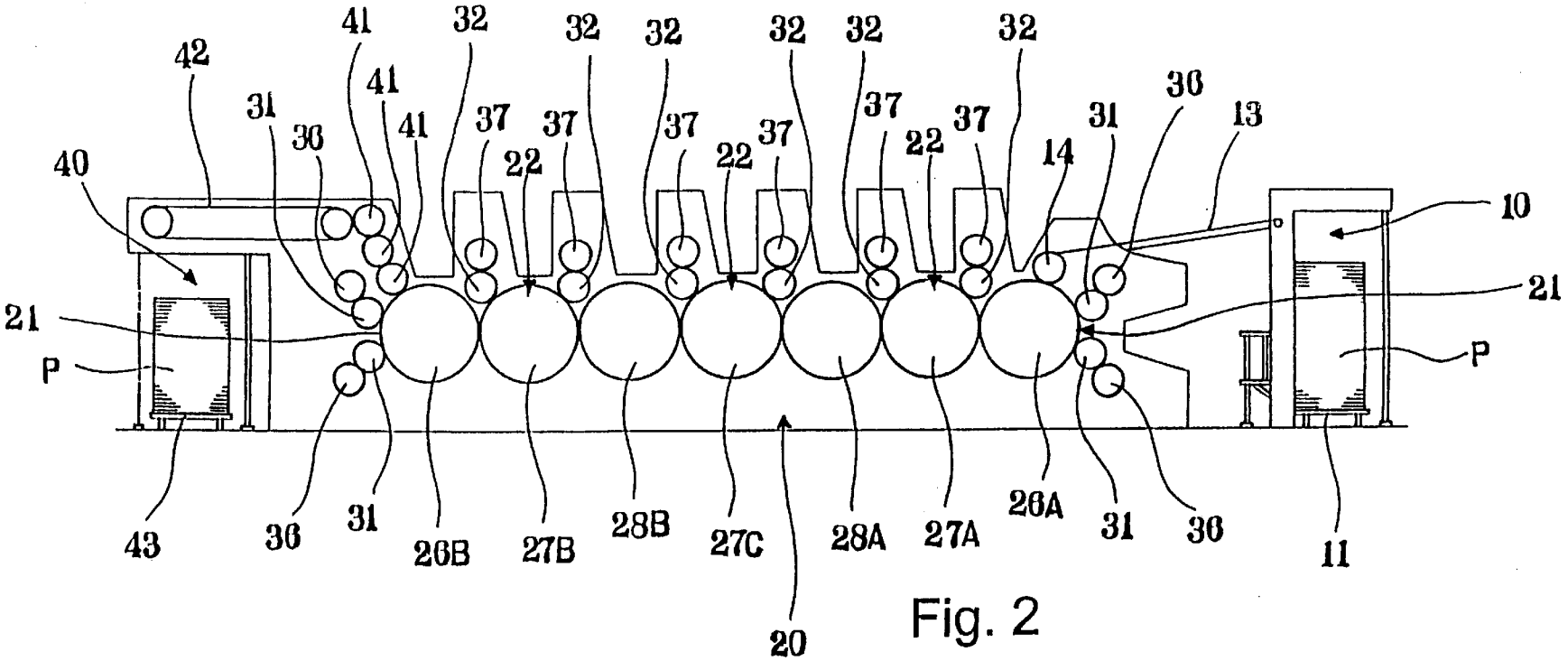
FIG. 2 is a view similar to FIG. 1 schematically illustrating a multicolor offset perfecting press according to the invention particularly adapted for six-color printing on the top side and four-color printing on the back side.

FIG. 1 is a side view schematically illustrating a first embodiment of the invention particularly adapted for four-color printing on the top side and four-color printing on the back side, and FIG. 2 is a view similar to FIG. 1 schematically illustrating a second embodiment of the invention particularly adapted for six-color printing on the top side and four-color printing on the back side. As illustrated, paper sheets P are successively fed via a feeder cylinder 14 from a feeder station 10 to a printing station 20 where the paper sheets P are printed on both sides thereof and then transported via a delivery cylinder 41 to a delivery station 40.

The feeder station 10 comprises a feeder table 11 on which the sheets P are stacked, a sheet feeder plate 13 and a feeder cylinder 14 provided with a catch claw (not shown) and serving to link the feeder plate 13 to a compression cylinder 26A and provided with a catch claw (not shown).

The printing station 20 comprises offset cylinders 31, 32, plate cylinders 36, 37 being in contact and operatively associated with the offset cylinders 31, 32, respectively, compression cylinders 26, 27 and an intermediate cylinder 28 provided with catch claws (not shown), respectively, wherein the compression cylinders as well as the intermediate cylinder have their diameters threefold larger than those of the offset cylinders 31, 32, respectively. These components constitute a back side printing unit 21 and a top side printing unit 22. The back side printing unit 21 has its compression cylinders 26 each adapted to be in contact and operatively associated on its one side with the horizontally adjoining compression cylinder 27 of the top side printing unit 22 and in contact and operatively associated on its other side with a vertically arranged pair of offset cylinders 31, 31. The top side printing unit 22 has the compression cylinders 27 each adapted to be in contact and operatively associated on its one side with the horizontally adjoining intermediate cylinder 28 and on its other side with the horizontally adjoining compression cylinder 26 of the back side printing unit 21. The top side printing unit 22 additionally includes two pairs of the offset cylinders 32, 32 horizontally spaced one from another, the pairs being in contact from obliquely above with the compression cylinders 27, 27 lying on feeder and delivery sides, respectively, and operatively associated with them. Six-color printing of the top side may be achieved, for example, by supplementing the above-mentioned arrangement of the top side printing unit 22 with an additional compression cylinder 27 on both sides of which there are provided with intermediate cylinders 28 horizontally arranged to be in contact and operatively associated with the additional compression cylinder 27 and an additional pair of the offset cylinders 32, 32 being horizontally spaced from each other and also from the other pairs of the offset cylinders 32, 32 to be in contact and operatively associated, from obliquely above, with the additional compression cylinder 27 as illustrated in FIG. 2. Details of these arrangements as have been described above will be more fully explained later on the basis of two specific embodiments illustrated by the respective figures.

The delivery station 40 comprises delivery cylinders 41 serving to transport the printed paper sheets P and provided with catch claws (not shown), respectively, a delivery conveyor 42 and a delivery table 43 on which the conveyed paper sheets P are successively stacked. While the delivery cylinders 41 are illustrated to be three, the number of the delivery cylinders 41 is not limited to three and may be one or more.

According to the first embodiment illustrated in FIG. 1, provided are the back side printing units 21 on the side of the feeder station as well as on the side of the delivery station, respectively. The compression cylinder 26A of the back side printing unit 21 provided on the side of the feeder station is in contact and operatively associated with the compression cylinder 27A of the top side printing unit 22 provided on the same side, while the compression cylinder 26B of the back side printing unit 21 provided on the side of the delivery station is in contact and operatively associated with the compression cylinder 27B of the top side printing unit 22 provided on the same side. The compression cylinders 27A, 27B are in contact and operatively associated also with the intermediate cylinder 28.

The manner in which such specific embodiment of the inventive multicolor offset perfecting press adapted for four-color printing on the top side and four-color printing on the back side operates will now be described.

The paper sheets P are stacked on the feeder table 11 and successively transported by the feeder plate 13 to the feeder cylinder 14 which successively catches the paper sheets P with its catch claw and successively transports them to the adjoining compression cylinder 26A. The paper sheet P having been transported to the compression cylinder 26A is caught by its catch claw and transported forward. In the course of this transport, the paper sheet P has its back side two-color printed by the pair of offset cylinders 31, 31 being in contact and operatively associated with compression cylinder 26A. The paper sheet P having its back side two-color printed passes along the lower portion of the compression cylinder 26A and then is caught by the catch claw of the compression cylinder 27A. The paper sheet P then travels along the upper portion of the compression cylinder 27A and, in the course of this travelling, has its top side two-color printed by the pair of offset cylinders 32, 32 being in contact and operatively associated with this compression cylinder 27A. The paper sheet P is then transferred from the compression cylinder 27A to the intermediate cylinder 28 and, after its travel along the lower portion of the intermediate cylinder 28, is caught by the compression cylinder 27B. These steps of operation are exactly repeated so that the paper sheet P has its top side additionally two-color printed in the course of its travel along the compression cylinder 27B and its back side additionally two-color printed in the course of its travel along the compression cylinder 26B. The paper sheets P having had their top side four-color printed and their back side four-color printed are successively transported to the delivery cylinders 41 and then stacked via the delivery conveyor 42 on the delivery table 43.

According to the second embodiment illustrated in FIG. 2, provided are the back side printing units 21 on the side of the feeder as well as on the side of the delivery station, respectively. The compression cylinder 26A of the back side printing unit 21 provided on the side of the feeder station is in contact and operatively associated with the compression cylinder 27A of the top side printing unit 22 provided on the same side, while the compression cylinder 26B of the back side printing unit 21 provided on the side of the delivery station is in contact and operatively associated with the compression cylinder 27B of the top side printing unit 22 provided on the same side. Simultaneously, the compression cylinder 27A is in contact and operatively associated also with the intermediate cylinder 28A which is, in turn, in contact and operatively associated with the compression cylinder 27C which is, in turn, in contact and operatively associated with the other intermediate cylinder 28B.

The manner in which such specific embodiment of the inventive multicolor offset perfecting press adapted for six-color printing on the top side and four-color printing on the back side operates will now be described.

Similarly to the first embodiment, the paper sheets P are stacked on the feeder table 11 and successively transported by the feeder plate 13 to the feeder cylinder 14 which successively catches the paper sheets P with its catch claw similar to those provided on the compression cylinders 26, 27 as well as on the intermediate cylinders 28 and successively transports the paper sheets P to the compression cylinder 26A. The paper sheet P having been transported to the compression cylinder 26A is caught by its catch claw and transported forward. In the course of this transport, the paper sheet P has its back side two-color printed by the pair of offset cylinders 31, 31 being in contact and operatively associated with the compression cylinder 26A. The paper sheet P having its back side two-color printed then passes along the lower portion of the compression cylinder 26A and is caught by the catch claw of the compression cylinder 27A. The paper sheet P then travels along the upper portion of the compression cylinder 27A and, in the course of this travelling, has its top side two-color printed by the pair of offset cylinders 32, 32 being in contact and operatively associated with the compression cylinder 27A. The paper sheet P is then transferred from the compression cylinder 27A to the intermediate cylinder 28A and, after its travel along the lower portion of this intermediate cylinder 28A, is caught by the catch claw of the compression cylinder 27C. These steps of operation are exactly repeated. Namely, the paper sheet P has its top side additionally two-color printed as it travels along the compression cylinder 27C. Then, the paper sheet P is transported by the intermediate cylinder 28B to the compression cylinder 27B and, in the course of its travel along this compression cylinder 27B, has its top side further two-color printed. Finally, the paper sheet P has its back side further two-color printed in the course of its travel along the compression cylinder 26B. The paper sheets P having had their top side six-color printed and their back side four-color printed in this manner are successively transported to the delivery cylinders 41 and then stacked via the delivery conveyor 42 on the delivery table 43.

Accordingly, the printing station in the multicolor offset perfecting press according to the invention basically comprises offset cylinders, plate cylinders adapted to be in contact and operatively associated with the offset cylinders, and compression cylinders and at least one intermediate cylinder both having their diameters threefold larger than those of the offset cylinders. In such a perfecting press, a printing station comprises at least a pair of back side printing units and at least a pair of top side printing units. Each of the back side printing units is adapted to be horizontally in contact and operatively associated, on one side, with one of the compression cylinders and in contact and operatively associated, on the other side, with vertically paired offset cylinders. Each of the top side printing units is adapted to be horizontally in contact and operatively associated with, on one side, the intermediate cylinder and horizontally in contact and operatively associated, on the other side, with the intermediate cylinder or one of the compression cylinders of the back side printing unit. The top side printing units further comprise respective pairs of offset cylinders, each pair being horizontally spaced from each other and in contact and operatively associated from obliquely above with the compression cylinders on the feeder and delivery sides. These back side printing units and top side printing units are thus compactly unitized together. In the case of four-color printing on the top side and four-color printing on the back side, the known conventional arrangement has required eight compression cylinders. In contrast, the novel arrangement advantageously decreases the number of compression cylinders from eight to four. Decrease in the number of compression cylinders by four means a saving of the space which would otherwise be occupied by these four additional compression cylinders. In addition, decrease in the number of compression cylinders means a decrease in the number of times required for the paper sheet to be transferred from one compression cylinder to the next compression cylinder. Such feature allows the top side printing and back side printing to be easily and exactly registered with each other and thereby allows a high precision perfecting operation to be achieved. Furthermore, the unique arrangement so that the compression cylinders and the intermediate cylinder are horizontally in contact and operatively associated with one another is effective to reduce the height of the press and thereby to facilitate maintenance of the press.

Accordingly, the invention provides a novel multicolor offset perfecting press requiring a relatively small space and allowing the number of times the paper sheet must be transferred from one cylinder to the next cylinder to be reduced, thereby allowing high precision multicolor printing that is well registered to be obtained. In this way, the invention provides a novel multicolor offset perfecting press allowing its maintenance to be facilitated.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. A multicolor offset perfecting press comprising:

a printing station having offset cylinders, plate cylinders in contact and operatively associated with said offset cylinders, and compression cylinders and at least one intermediate cylinder both having diameters threefold larger than diameters of said offset cylinders, said printing station comprising at least a pair of back side printing units and at least a pair of top side printing units arranged so as to be successively in contact and operatively associated together, each of said back side printing units being horizontally in contact and operatively associated, on one side, with one of said compression cylinders and in contact and operatively associated, on the other side, with vertically paired offset cylinders, each of said top side printing units being horizontally in contact and operatively associated, on one side, with a first one of said at least one intermediate cylinder and in contact and operatively associated, on the other side, with a second one of said at least one intermediate cylinder or one of said compression cylinders of said back side printing unit, wherein a pair of offset cylinders are horizontally spaced from each other to be in contact and operatively associated from obliquely above with the respective compression cylinders on a feeder side and a delivery side;

a feeder station including a feeder cylinder in contact and operatively associated from obliquely above with the compression cylinder lying on the feeder side; and a delivery station including a delivery cylinder being in contact and operatively associated from obliquely above with the compression cylinder lying on the delivery side.

2. The multicolor offset perfecting press according to claim 1, wherein said back side printing units are provided on the feeder side and the delivery side, respectively, and said top side printing units are provided between said back side printing units.

3. A multicolor offset perfecting press comprising:

a printing station having offset cylinders, plate cylinders in contact and operatively associated with said offset cylinders, compression cylinders, and at least one intermediate cylinder, said compression cylinders and said at least one intermediate cylinder having diameters approximately threefold larger than diameters of said offset cylinders, said printing station comprising at least a pair of back side printing units and at least a pair of top side printing units arranged so as to be successively in contact and operatively associated together, each of said back side printing units being horizontally in contact and operatively associated, on one side, with one of said compression cylinders and in contact and operatively associated, on the other side, with a pair of vertically offset cylinders, each of said top side printing units being horizontally in contact and operatively associated, on one side, with a first one of said at least one intermediate cylinder and in contact and operatively associated, on the other side, with a second one of one of said at least one intermediate cylinder or one of said compression cylinders of said back side printing unit, each of said top side printing units further having a pair of horizontally offset cylinders horizontally spaced from each other to be in contact and operatively associated from obliquely above with the respective compression cylinders on a feeder side and a delivery side;

a feeder station including a feeder cylinder in contact and operatively associated from obliquely above with the compression cylinder lying on the feeder side; and a delivery station including a delivery cylinder being in contact and operatively associated from obliquely above with the compression cylinder lying on the delivery side.

* * * * *